United States Patent [19]

Kervizic et al.

[11] 4,095,201

[45] June 13, 1978

[54] DEVICE FOR THE MAGNETIC CORRECTION OF THE TRAJECTORIES OF A BEAM OF ACCELERATED PARTICLES EMERGING FROM A CYCLOTRON

[75] Inventors: Jacques Kervizic; Bernard Hurt, both of Paris, France

[73] Assignee: C.G.R. MeV, Paris, France

[21] Appl. No.: 711,801

[22] Filed: Aug. 5, 1976

[30] Foreign Application Priority Data

Aug. 8, 1975 France ..... 75 24803

[51] Int. Cl.[2] ..... H01F 7/00

[52] U.S. Cl. ..... 335/210; 313/62

[58] Field of Search ..... 335/210, 296, 212; 313/62; 328/234

[56] References Cited

U.S. PATENT DOCUMENTS

| | | | |
|---|---|---|---|
| 2,962,636 | 11/1960 | Purcell | 335/296 |
| 3,009,083 | 11/1961 | Sipek | 335/210 |
| 3,274,502 | 9/1966 | Pinel et al. | 335/210 X |
| 3,315,194 | 4/1967 | Standing | 313/62 X |

*Primary Examiner*—George Harris

*Attorney, Agent, or Firm*—Oblon, Fisher, Spivak, McClelland & Maier

[57] ABSTRACT

A magnetic correcting device for locally modifying the strength of the magnetic field of a cylcotron in the zone of extraction of the accelerated particles to promote the extraction function and to ensure a suitable focusing of the emergent beam. In one embodiment, the device comprises a block of prismatic shape made of a composite laminated material formed by a stack of plates $P_1$ and $P_2$ of different permeabilities. The plates $P_1$ are for example made of cobalt steel and those $P_2$ of an non-magnetic material (copper for example).

9 Claims, 3 Drawing Figures

DEVICE FOR THE MAGNETIC CORRECTION OF THE TRAJECTORIES OF A BEAM OF ACCELERATED PARTICLES EMERGING FROM A CYCLOTRON

The extraction of the beam of accelerated particles from the air-gap of a cyclotron requires a very strong electric field generated by an extractor electrode arranged at the periphery of the cyclotron, and also requires a correction of the magnetic field in the neighbourhood of said extractor electrode. This correction of the stray magnetic field of the cyclotron makes it possible to modify the mean path of the emergent beam and to focus the beam suitably (focusing in the horizontal plane in particular).

Conventional magnetic correctors used for very high-intensity magnetic fields, that is to say at the location of the extractor electrode, are generally constituted by coils carrying very heavy currents, this being an expensive and bulky solution to the problem.

So called "passive" correctors utlising the ferromagnetic properties of certain materials, are used in zones of weak magnetic field, that is to say at a certain distance from the extractor electrode and are consequently ineffective in controlling the beam at the location of the electrode itself.

The object of the present invention is a magnetic correcting device of the "passive type", intended to be used in the extraction zone of a cyclotron, this zone being submitted to a high magnetic field strength.

In accordance with the invention, there is provided a magnetic correcting device for correcting the trajectories of a beam of accelerated charged particles emerging from an accelerator of cyclotron type, said cylcotron being associated with an electromagnet having two parallel circular polepieces between which said particles are accelerated, said cyclotron being provided with a peripheral extractive electrode for extracting said particles from said cyclotron, said correcting device, which is designed for modifying the mean path of said particles beam emerging from said cyclotron and for focusing said emergent beam, being located at the periphery of said polepieces in the neighborhood of said extractive electrodes, said device comprising at least one block of magnetic material of a predetermined shape, said block being constituted by a laminated composite magnetic material formed by a stack of plates made of materials having different permeabilities, said plates being arranged in planes which make predetermined angles in relation to the plane of the mean paths of said particle beam.

For a better understanding of the invention and to show how the same may be carried into effect, reference will be made to the drawings, given solely by way of example, which accompany the following description, and wherein.

The magnetic correcting device according to the invention is designed for modifying the mean path of an accelerated particle beam emerging from a cyclotron and for focusing this emerging particle beam. The cyclotron is associated with an electromagnet having two parallel polepieces between which are accelerated the charged particles and is provided with an extractor electrode arranged in a known manner at the periphery of the polepieces (not shown). The magnetic correcting device intended to be located in the vicinity of the extractor electrode is constituted, in the example shown in FIG. 1, with a block 1 of prismatic shape, constituted by a stack of plates $P_1$ of ferromagnetic material (mild steel for example) alternating with plates $P_2$ of non-magnetic material (copper for example), said plates $P_1$ and $P_2$ being arranged in planes parallel to the plane of the mean paths of the particles accelerated in the cyclotron. If all the plates $P_1$ have a same thickness equal to $e_1$ and if all the plates $P_2$ have a same thickness equal to $e_2$, then the permeability of the composite laminated material formed by the stack of plates $P_1$ $P_2$, is given by:

$$\mu = (e_1 + e_2)/e_2$$

on condition that the ratio $(e_1 + e_2)/e_2$ is substantially smaller than the permeability of the ferromagnetic material.

Figure 1:
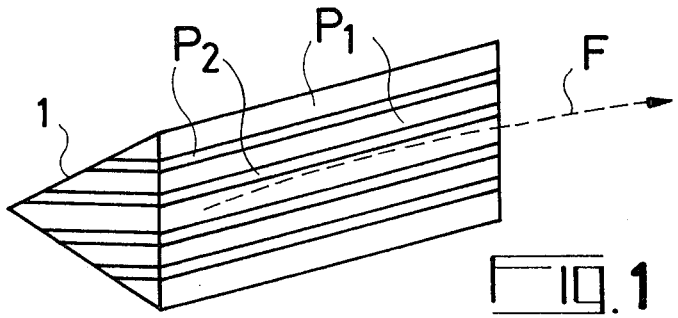
FIGS. 1 and 3 illustrate two embodiments of a magnetic correcting device in accordance with the invention.

If the ferromagnetic material is mild steel, a magnetic correcting device as shown in FIG. 1 can be used for magnetic flux densities of up to 20,000 Gauss. In the case of cobalt steel, it is possible to achieve 25,000 Gauss.

Figure 2:
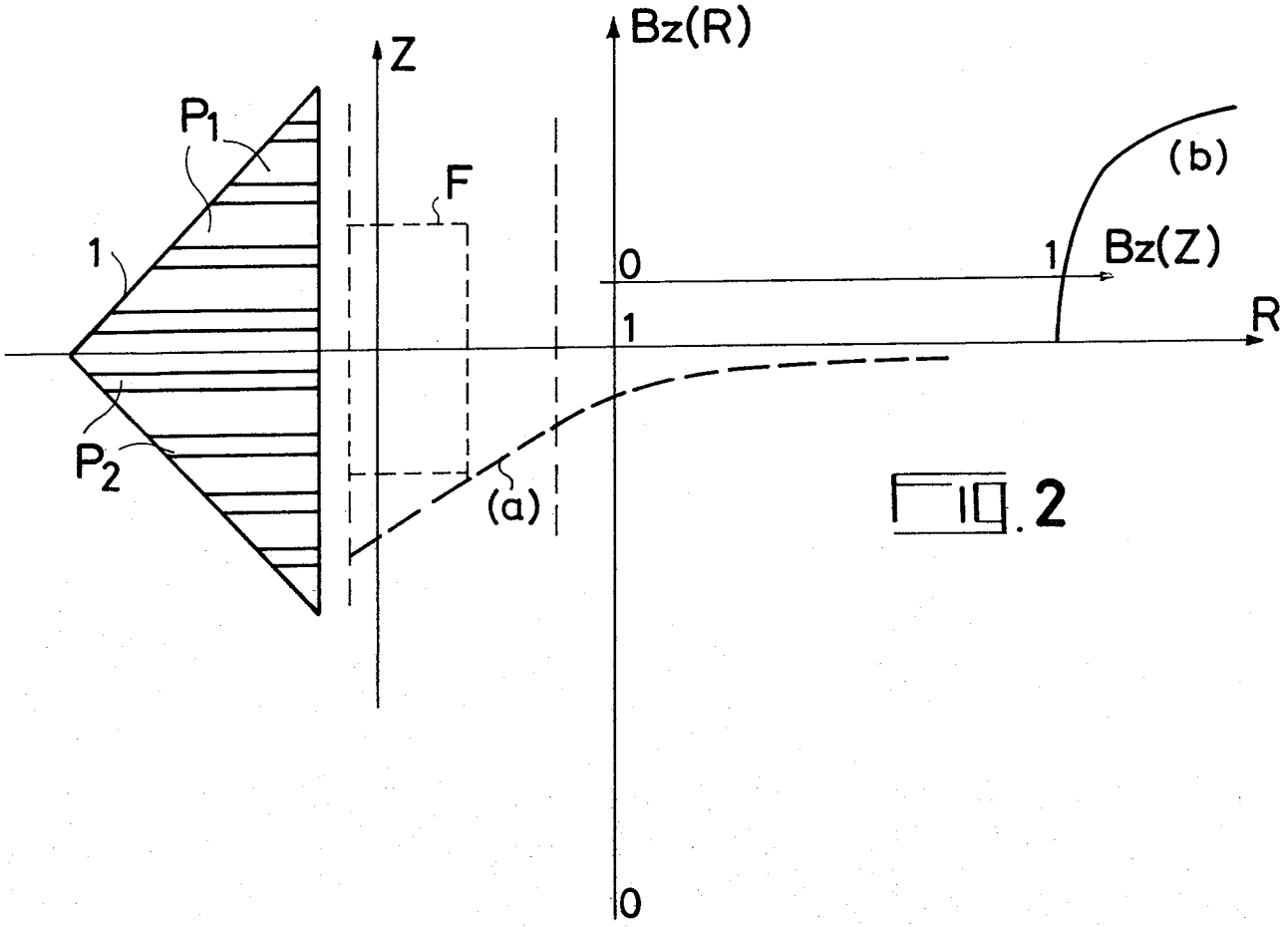
FIG. 2 illustrates the variation of the magnetic field, which is obtained using a correcting device in accordance with the invention.

The graphs shown in FIG. 2 illustrate the distribution of the magnetic field $B_Z$ in two axes X and R contained in a plane substantially perpendicular to the lamination plane, the axis Z being perpendicular to the plane of the mean paths of the beam F and the axis R being an axis located along a radius of the mean paths of the beam. The graph (*a*) illustrates the distribution $B_Z(R)$ and the graph (*b*) the distribution $B_Z(Z)$ of the magnetic field between the edge of the cyclotron and the magnetic correcting device in accordance with the invention.

Figure 3:
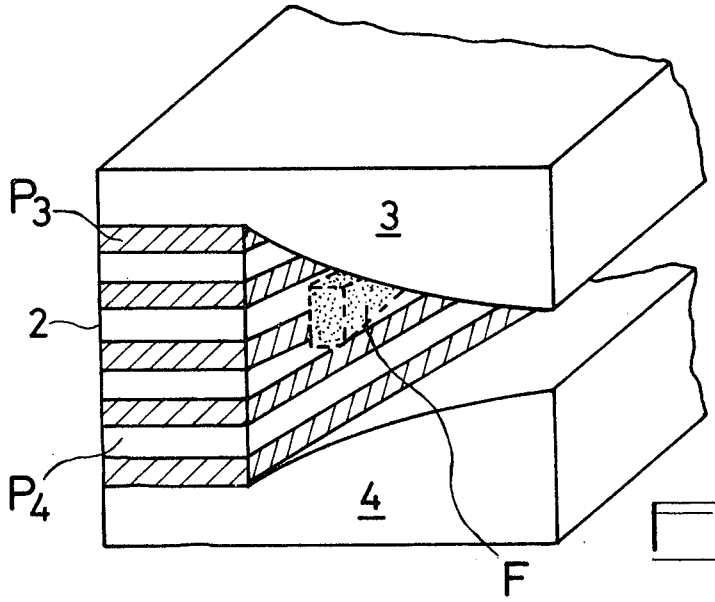

FIG. 3 illustrates a second embodiment of a magnetic correcting device in accordance with the invention. This device comprises a parallelepipedic block of composite laminated material constituted by a stack of plates $P_3$ and $P_4$ respectively made of ferromagnetic material and non-magnetic material, said block 2 being arranged between two auxiliary polepieces 3 and 4 of ferromagnetic material having a predetermined shape. By choosing the profile of these auxiliary polepieces 3 and 4 and also the characteristics of the laminated material (thicknesses of the plates $P_3$ and $P_4$, choice of the material constituting said plates $P_3$ and $P_4$), it is possible to accurately produce the desired magnetic field distribution at the magnetic correcting device.

It should be pointed out that the magnetic correcting devices of the second embodiment are more sensitive to the effects of saturation than are those corresponding to the first embodiment described earlier.

These magnetic correcting devices make it possible to locally reduce the magnetic field in order to promote the extraction of the accelerated beam from the air-gap of the cyclotron and ensure proper focusing of the extracted beam by means of the positive magnetic field gradient which is developed.

We claim:

1. A magnetic correcting device for correcting the trajectories of a beam of accelerated charged particles emerging from an accelerator of cyclotron type, said cyclotron being associated with an electromagnet having two parallel circular polepieces between which said particles are accelerated, said cyclotron being provided with a peripheral extractive electrode for extracting said particles from said cyclotron, said device, which is designed for modifying the mean path of said particle beam emerging from said cyclotron and for focusing said emergent beam, being located at the periphery of said polepieces in the neighborhood of said extractive electrode, said device comprising at least a block of magnetic material having a predetermined shape, said block being constituted by a laminated composite magnetic material formed by a stack of plates made of materials having different permeabilities, said plates being arranged in planes which make predetermined angles in relation to the plane of the mean paths of said beam.

2. A magnetic correcting device as claimed in claim 1, wherein said plates are arranged in planes substantially parallel to the particles mean path in said cyclotron.

3. A magnetic correcting device as claimed in claim 1, wherein said block is formed by a stack of plates alternately composed of ferromagnetic material and non-magnetic material.

4. A magnetic correcting device as claimed in claim 3, wherein said plates of ferromagnetic material have a same thickness $e_1$ and said plates of non-magnetic material have a same thickness $e_2$, the permeability of the composite laminated material thus produced being:

$$\mu = (e_1 + e_2)/e_2$$

5. A magnetic correcting device as claimed in claim 1, wherein said block has a prismatic shape.

6. A magnetic correcting device as claimed in claim 1, wherein said block is of parallelepipedic form.

7. A magnetic correcting device as claimed in claim 6, wherein said block of composite material is arranged between two auxiliary polepieces of ferromagnetic material, one of the extremeties of each of said auxiliary polepieces, which have a predetermined shape, resting respectively upon the opposite faces of said block, said opposite faces being parallel to said plates.

8. A magnetic correcting device as claimed in claim 3, wherein said ferromagnetic material is cobalt steel.

9. A magnetic correcting device as claimed in claim 3, wherein said non-magnetic material is copper.

* * * * *